US011434104B2

(12) United States Patent
Fargo

(10) Patent No.: US 11,434,104 B2
(45) Date of Patent: Sep. 6, 2022

(54) CONTINUOUS MONITORING OF RAIL AND RIDE QUALITY OF ELEVATOR SYSTEM

(71) Applicant: OTIS ELEVATOR COMPANY, Farmington, CT (US)

(72) Inventor: Richard N. Fargo, Chatham, NH (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 913 days.

(21) Appl. No.: 15/835,653

(22) Filed: Dec. 8, 2017

(65) Prior Publication Data

US 2019/0177114 A1 Jun. 13, 2019

(51) Int. Cl.

| | |
|---|---|
| ***B66B 5/00*** | (2006.01) |
| ***B66B 5/16*** | (2006.01) |
| ***B66B 7/12*** | (2006.01) |
| ***B66B 1/32*** | (2006.01) |
| ***B66B 7/02*** | (2006.01) |
| ***B66B 5/18*** | (2006.01) |
| ***B66B 5/06*** | (2006.01) |

(52) U.S. Cl.

CPC ..... *B66B 1/32* (2013.01); *B66B 5/0031* (2013.01); *B66B 5/06* (2013.01); *B66B 5/16* (2013.01); *B66B 5/18* (2013.01); *B66B 7/02* (2013.01); *B66B 7/1246* (2013.01)

(58) Field of Classification Search

USPC ..... 187/288

See application file for complete search history.

(56) References Cited

U.S. PATENT DOCUMENTS

| | | | | |
|---|---|---|---|---|
| 5,086,882 | A * | 2/1992 | Sugahara | B66B 7/046 187/410 |
| 5,214,947 | A * | 6/1993 | Sissala | B66B 19/002 72/17.3 |
| 5,351,516 | A * | 10/1994 | Bialy | B23P 6/00 72/199 |
| 5,931,264 | A | 8/1999 | Gillingham et al. | |
| 6,109,398 | A | 8/2000 | Lempio et al. | |
| 6,435,315 | B1 | 8/2002 | Zaharia | |
| 6,809,650 | B2 | 10/2004 | Pfenniger et al. | |
| 7,210,242 | B2 | 5/2007 | Sun et al. | |

(Continued)

FOREIGN PATENT DOCUMENTS

| | | | |
|---|---|---|---|
| CN | 1994843 | A | 7/2007 |
| CN | 102211725 | A | 10/2011 |

(Continued)

OTHER PUBLICATIONS

European Search Report for U.S. Appl. No. 18/211,125; dated May 27, 2019; 8 Pages.

(Continued)

*Primary Examiner* — Christopher Uhlir

(74) *Attorney, Agent, or Firm* — Cantor Colburn LLP

(57) ABSTRACT

A safety actuation device for an elevator system including an elevator car and a guide rail includes a safety brake disposed on the car and adapted to be forced against the guide rail when moved from a non-braking state to a braking state. An electronic safety actuator is operably connected to the safety brake. The electronic safety actuator includes at least one sensor configured to monitor one or more parameters associated with a ride quality of the elevator car.

18 Claims, 4 Drawing Sheets

(56) References Cited

U.S. PATENT DOCUMENTS

| | | | | |
|---|---|---|---|---|
| 7,398,863 | B2 * | 7/2008 | Liebetrau | B66B 5/18 187/367 |
| 7,588,127 | B2 * | 9/2009 | Shiratsuki | B66B 1/3492 187/391 |
| 7,597,176 | B2 | 10/2009 | Zaharia | |
| 8,573,365 | B2 | 11/2013 | Ito | |
| 9,457,989 | B2 | 10/2016 | Meierhans et al. | |
| 9,695,011 | B2 | 7/2017 | Hugel et al. | |
| 9,718,643 | B2 | 8/2017 | Van Der Meijden et al. | |
| 2011/0308895 | A1 | 12/2011 | Shen et al. | |
| 2014/0138189 | A1 * | 5/2014 | van der Meijden | B66B 5/0087 187/406 |
| 2015/0217972 | A1 * | 8/2015 | Hawkins | B66B 19/002 187/391 |
| 2015/0307319 | A1 * | 10/2015 | Michel | G05B 15/02 700/275 |
| 2016/0122156 | A1 * | 5/2016 | Kondo | B66B 9/00 187/247 |
| 2016/0304315 | A1 | 10/2016 | Vaunois et al. | |
| 2016/0325967 | A1 | 11/2016 | Ou et al. | |
| 2017/0283216 | A1 | 10/2017 | Marvin et al. | |
| 2017/0341910 | A1 | 11/2017 | Bitzi et al. | |
| 2019/0152745 | A1 * | 5/2019 | Chae | B66B 1/28 |

FOREIGN PATENT DOCUMENTS

| | | | |
|---|---|---|---|
| CN | 102874665 | A | 1/2013 |
| CN | 105173977 | A | 12/2015 |
| CN | 205739870 | U | 11/2016 |
| CN | 107265242 | A | 10/2017 |
| DE | 10150284 | A1 | 4/2003 |
| EP | 1972593 | A1 | 9/2008 |
| EP | 2562123 | A1 | 2/2013 |
| EP | 3225578 | A1 | 10/2017 |
| EP | 3225579 | A1 | 10/2017 |
| JP | H10139308 | A | 5/1998 |
| JP | 3075907 | B2 | 8/2000 |
| JP | 2001199654 | A | 7/2001 |
| JP | 5294583 | B2 | 9/2013 |
| WO | 9323323 | A1 | 11/1993 |

OTHER PUBLICATIONS

Third Chinese Office Action; Chinese Application No. 201811495802.9; dated Jun. 29, 2021; 7 pages.

Second Office Action; Chinese Application No. 201811495802.9; International Filing Date: Dec. 7, 2018; dated Jan. 21, 2021; 13 pages with translation.

First Chinese Office Action; Chinese Application No. 201811495802.9; dated Apr. 9, 2020; 13 pages.

* cited by examiner

CONTINUOUS MONITORING OF RAIL AND RIDE QUALITY OF ELEVATOR SYSTEM

BACKGROUND

Embodiments described herein relate to elevator braking systems and, more particularly, to systems and methods for utilizing a safety braking system to monitor various parameters of the elevator system.

Elevator systems typically include a car that moves within a hoistway to transport passengers or items between various levels in a building. Guide rails mounted within the hoistway guide the elevator car within the hoistway. The elevator car includes a plurality of roller guides or slide guides that guide the car along each guide rail. Misalignment of the guide rails or irregularities in the guide rail surfaces can reduce the ride quality of the elevator system. Inconsistencies in the alignment or surfaces of the guide rails typically are transmitted to the cabin of the car assembly through the g system, resulting in vibrations felt by passengers, for example. Further, degradation of the rails may be caused by settling of a building, temperature variation, or contamination by rust or other contaminants, including oil or a corrosion inhibitor. This degradation in the rail surface may impact operation of the components that cooperate with the rails.

BRIEF SUMMARY

According to some embodiments, a safety actuation device for an elevator system including an elevator car and a guide rail includes a safety brake disposed on the car and adapted to be forced against the guide rail when moved from a non-braking state to a braking state. An electronic safety actuator is operably connected to the safety brake to monitor a speed of the elevator car and monitor one or more parameters associated with a ride quality of the elevator car.

In addition to one or more of the features described herein, or as an alternative, in further embodiments the one or more parameters associated with the ride quality of the elevator car includes an acceleration of the elevator car.

In addition to one or more of the features described herein, or as an alternative, in further embodiments the one or more parameters associated with the ride quality of the elevator car includes a condition of the guide rail.

In addition to one or more of the features described herein, or as an alternative, in further embodiments the condition of the guide rail includes a surface roughness of the guide rail.

In addition to one or more of the features described herein, or as an alternative, in further embodiments the condition of the guide rail includes a straightness of the guide rail.

In addition to one or more of the features described herein, or as an alternative, in further embodiments the condition of the guide rail includes a distance between the electronic safety actuator and the guide rail.

In addition to one or more of the features described herein, or as an alternative, in further embodiments the sensor is an accelerometer.

In addition to one or more of the features described herein, or as an alternative, in further embodiments the sensor is an optical sensor or laser.

In addition to one or more of the features described herein, or as an alternative, in further embodiments the sensor is one of a gap sensor and an inductive sensor.

In addition to one or more of the features described herein, or as an alternative, in further embodiments the sensor is an inductive sensor.

In addition to one or more of the features described herein, or as an alternative, in further embodiments the at least one sensor includes a first sensor for monitoring a speed of the elevator car and a second sensor for determining if the first sensor is located an acceptable distance from the guide rail.

According to another embodiment, a method of operation an elevator system having an elevator car and a guide rail includes moving the elevator car and an electronic safety actuator coupled to the elevator car within a hoistway and monitoring one or more parameters associated with a ride quality of the elevator car using at least one sensor as the elevator car moves within the hoistway.

In addition to one or more of the features described herein, or as an alternative, in further embodiments comprising forcing a safety brake operably coupled to the electronic safety actuator against the guide rail to brake movement of the elevator car.

In addition to one or more of the features described herein, or as an alternative, in further embodiments comprising receiving information from the at least one sensor monitoring the one or more parameters associated with the ride quality and comparing the received information against at least one preset threshold.

In addition to one or more of the features described herein, or as an alternative, in further embodiments comprising identifying one or more regions of a path of movement of the elevator car where maintenance is required.

In addition to one or more of the features described herein, or as an alternative, in further embodiments identifying one or more regions of the path of movement of the elevator car where maintenance is required includes determining locations of the guide rail where the received information exceeds the at least one preset threshold.

In addition to one or more of the features described herein, or as an alternative, in further embodiments comprising generating a notification that maintenance is required at the locations of the guide rail where the received information exceeds the at least one preset threshold.

In addition to one or more of the features described herein, or as an alternative, in further embodiments the at least one sensor includes a sensor operable to detect a surface of the guide rail.

In addition to one or more of the features described herein, or as an alternative, in further embodiments a single sensor of the at least one sensor monitoring the speed of the elevator car and monitors the one or more parameters associated with the ride quality of the elevator car.

In addition to one or more of the features described herein, or as an alternative, in further embodiments the at least one sensor includes a first sensor and a second sensor, the first sensor being operable to monitor a speed of the elevator car and the second sensor being operable to monitor one or more parameters associated with the ride quality of the elevator car.

In addition to one or more of the features described herein, or as an alternative, in further embodiments the second sensor determines if the first sensor is located an acceptable distance from the guide rail.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
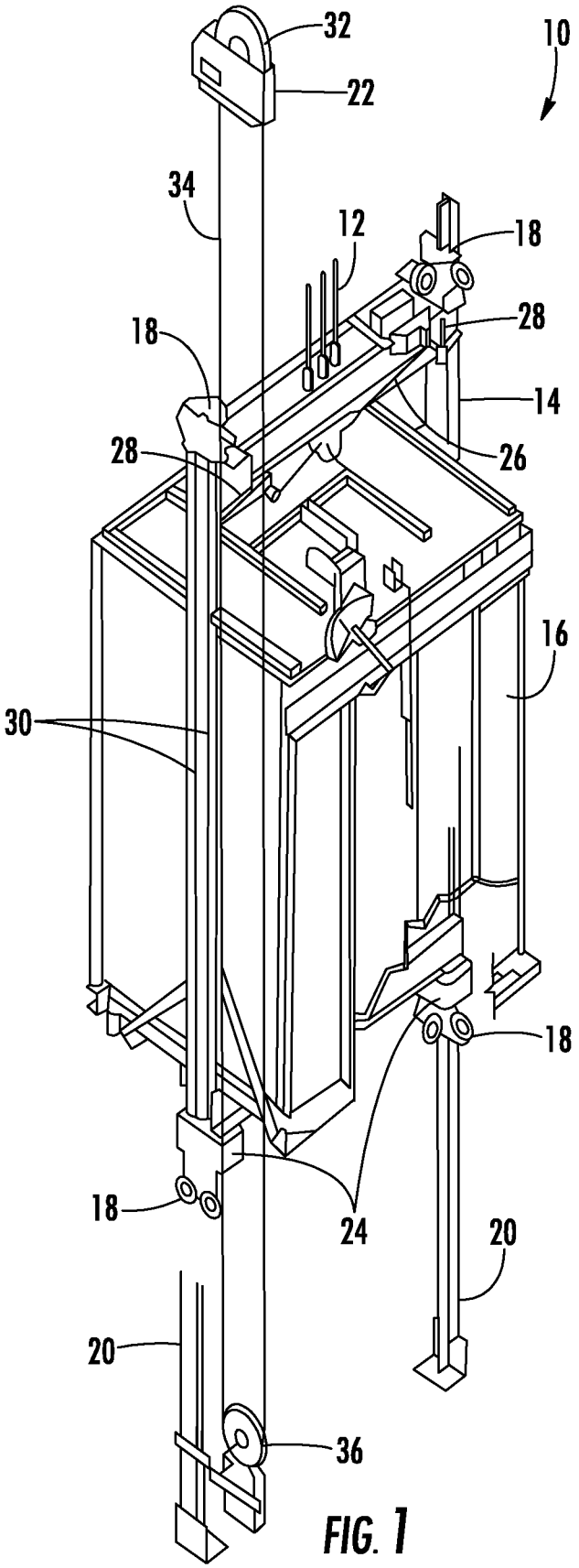
FIG. 1 is a schematic illustration of an elevator system that may employ various embodiments of the present disclosure.

With reference now to FIG. 1, an example of an elevator system, generally identified by numeral 10 is shown. The elevator system 10 includes cables 12, a car frame 14, an elevator car 16, roller guides 18, guide rails 20, a governor 22, safety brakes 24, linkages 26, levers 28, and lift rods 30. Governor 22 includes a governor sheave 32, rope loop 34, and a tensioning sheave 36. Cables 12 are connected to car frame 14 and a counterweight (not shown in FIG. 1) inside a hoistway. The elevator car 16, which is attached to the car frame 14, moves up and down within the hoistway by a force transmitted through cables or belts 12 to the car frame 14 by an elevator drive (not shown) commonly located in a machine room at the top of the hoistway. Roller guides 18 are attached to the car frame 14 to guide the elevator car 16 up and down within the hoistway along guide rail 20. Governor sheave 32 is mounted at an upper end of the hoistway. Rope loop 34 is wrapped partially around governor sheave 32 and partially around tensioning sheave 36 (located in this embodiment at a bottom end of the hoistway). Rope loop 34 is also connected to the elevator car 16 at lever 28, ensuring that the angular velocity of governor sheave 32 is directly related to the speed of elevator car 16.

In the elevator system 10 shown in FIG. 1, governor 22, an electromechanical brake (not shown) located in the machine room, and the safety brake 24 act to stop elevator car 16 if it exceeds a set speed as it travels inside the hoistway. If the elevator car 16 reaches an over-speed condition, governor 22 is triggered initially to engage a switch, which in turn cuts power to the elevator drive and drops the brake to arrest movement of the drive sheave (not shown) and thereby arrest movement of elevator car 16. If, however, the elevator car 16 continues to experience an over speed condition, governor 22 may then act to trigger the safety brake 24 to arrest movement of elevator car 16. In addition to engaging a switch to drop the brake, governor 22 also releases a clutching device that grips the governor rope 34. Governor rope 34 is connected to the safety brake 24 through mechanical linkages 26, levers 28, and lift rods 30. As elevator car 16 continues its descent unaffected by the brake, the governor rope 34, which is now prevented from moving by actuated governor 22, pulls on the operating lever 28. Operating lever 28 "sets" the safety brake 24 by moving linkages 26 connected to lift rods 30, thereby causing the safety brake 24 to engage the guide rails 20 to bring elevator car 16 to a stop.

Figure 2:
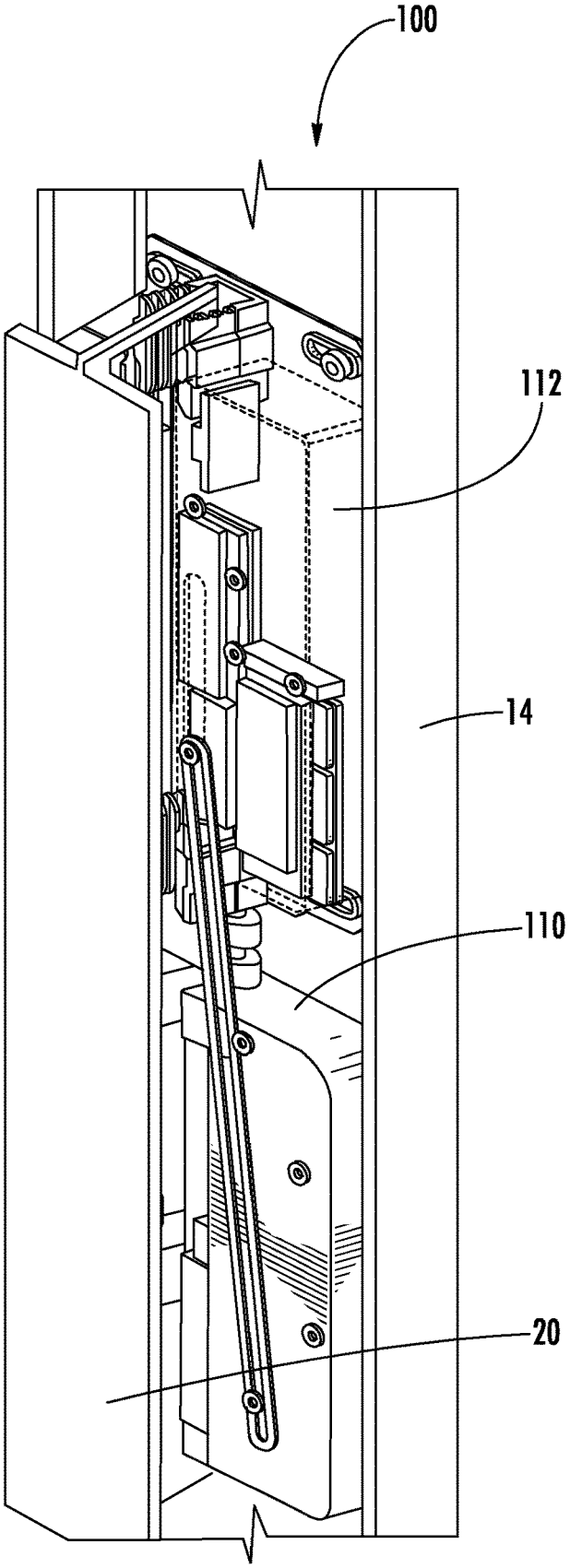
FIG. 2 is a schematic view of an elevator system having a safety brake assembly installed therewith.
Figure 3:
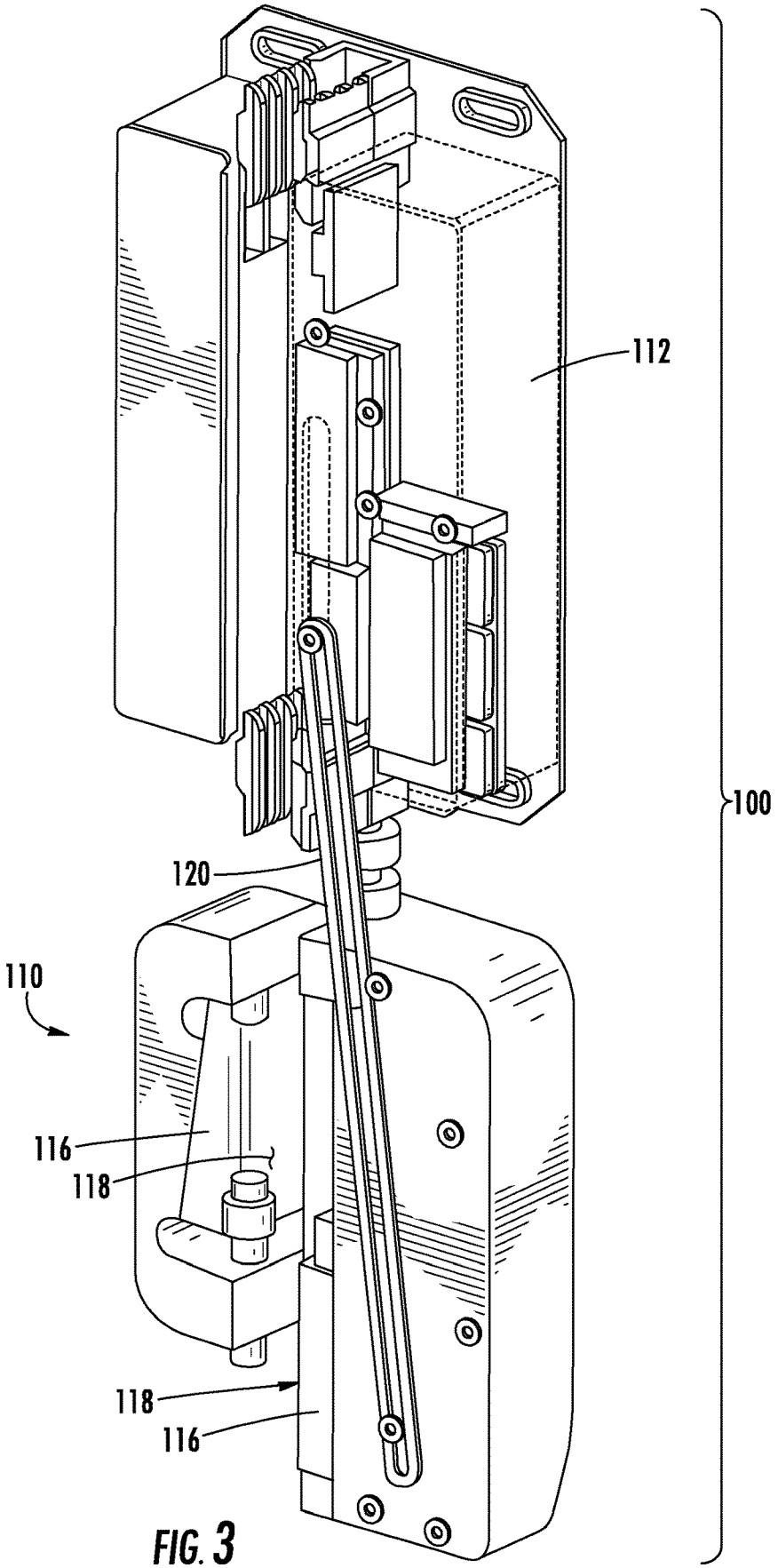
FIG. 3 is a schematic illustration of the safety brake assembly of FIG. 2 composed of a safety brake and safety actuator.

Mechanical speed governor systems, such as described with respect to FIG. 1, are being replaced in some elevators by electronic systems referred to herein as "electronic safety actuators." Referring now to FIGS. 2 and 3, an example of an electronic safety actuation device 100 suitable for actuating and resetting a safety brake 24 of the elevator system 10 is illustrated. The electronic safety actuation device 100 includes a safety brake 110 and an electronic safety actuator 112 that are operatively coupled to the elevator car, such as car 16 for example. In some embodiments, the safety brake 110 and the electronic safety actuator 112 are mounted to a car frame 14 of the elevator car 16. The safety brake 110 includes a brake member 116, such as a brake pad or a similar structure suitable for repeatable braking engagement with the guide rail 20. As shown, the brake member 116 has a contact surface 118 that is operable to frictionally engage the guide rail 20. The brake member 116 can be arranged in various different arrangements, including, but not limited to, wedge-brake configurations, magnetic-brake configurations, etc., as will be appreciated by those of skill in the art. In one non-limiting embodiment, the safety brake 110 and the electronic safety actuator 112 are combined into a single unit. In some embodiments, the electronic safety actuator 112 can include one or more electronic brake elements and/or activation magnets, with the electronic brake elements and/or activation magnets operably connected to a link member 120 to trigger activation of the brake member 116 (e.g., mechanical brake element).

The safety brake 110 is movable between a non-braking position and a braking position. During normal operation of the elevator car 16, the safety brake 110 is disposed in the non-braking position. In particular, in the non-braking position, the contact surface 118 of the brake member 116 is not in contact with, or is in minimal contact with the guide rail 20, and thus does not frictionally engage the guide rail 20. In the braking position, the frictional force between the contact surface 118 of the brake member 116 and the guide rail 20 is sufficient to stop movement of the elevator car 16 relative to the guide rail 20. Various triggering mechanisms or components may be employed to actuate the safety brake 110 and thereby move the contact surface 118 of the brake member 116 into frictional engagement with the guide rail 20. In the illustrated embodiment, the link member 120 is provided and operably couples the electronic safety actuator 112 and the safety brake 110. In operation, movement of the link member 120 triggers movement of the brake member 116 of the safety brake 110 from the non-braking position to the braking position, thus enabling emergency stopping of the elevator car 16.

Figure 4:
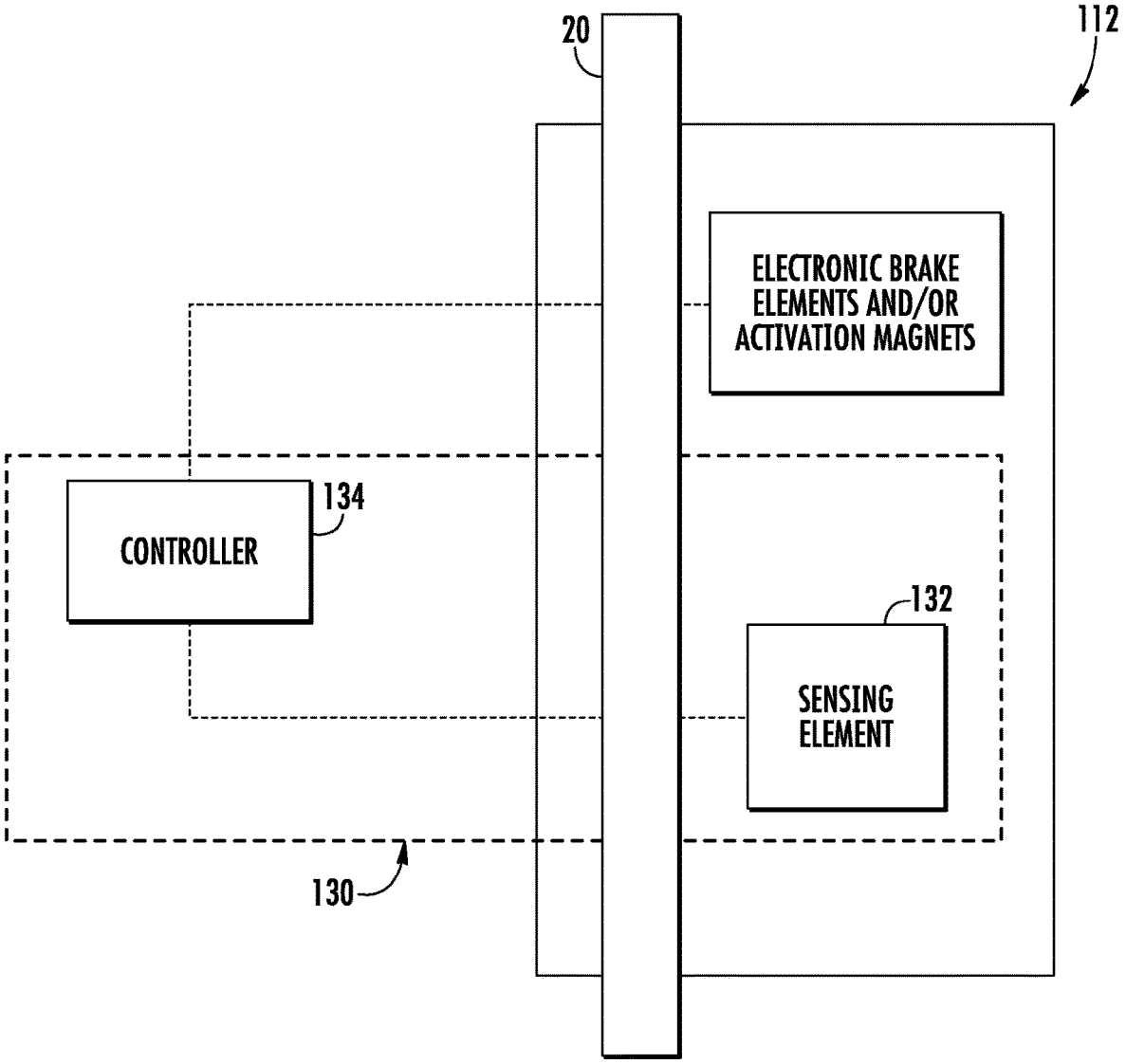
FIG. 4 is a schematic diagram of a sensing system of the safety brake of FIG. 3 according to an embodiment.

In operation, an electronic sensing system 130 (FIG. 4) operably coupled to the electronic safety actuation device 100 is configured to monitor various parameters and conditions of the elevator car 16 and to compare the monitored parameters and conditions to at least one predetermined condition. In some embodiments, the predetermined condition(s) includes speed and/or acceleration of the elevator car 16, counts for activation or operation of the electronic safety actuation device 100, etc. In one non-limiting example, in the event that a monitored condition such as over-speed, over-acceleration, etc., meets a predetermined condition, the electronic safety actuator 112 is actuated to facilitate engagement of the safety brake 110 and the guide rail 20. At the same time, a counter may be increased to indicate an actuation or operation of the electronic safety actuation device 100.

The electronic sensing system 130 includes one or more sensors or sensing elements 132 coupled to or embedded within the safety actuation device 100, and more specifically, the safety actuator 112. Each of the one or more sensing elements 132 is arranged in communication with a controller 134. In an embodiment, the controller 134 is part of the processing components, electronic storage components, sensing components, etc. of the electronic safety actuator 112 as will be appreciated by those of skill in the art (herein referred to as "onboard electronics"). The onboard electronics are used to monitor the one or more parameters during operation of the elevator, in situ, and in real time. Alternatively, the controller 134 may be the controller of the elevator system 10. In one embodiment, the controller 134 may be a mobile device such as a mobile phone, laptop, smart watch, service tool, etc. In one embodiment, the controller 134 may be a remotely located networked asset such as a cloud server or desktop computer. Accordingly, the controller 134 may be configured to receive, process, and in some embodiments store, the information provided by the one or more sensing elements 132, such as comparing the data against a predetermined threshold to monitor a condition of the elevator system 10. The predetermined thresholds can be predefined and programmed into the electronic sensing system 130. In an embodiment, the thresholds can be obtained through testing, empiric reliability data from prior systems, etc.

In an embodiment, the sensing elements 132 include a velocity sensor and/or an accelerometer. Alternatively, the sensing element 132 may include an optical sensor or laser configured to measure one or more markings located on the guide rail 20 to determine the speed of the elevator car 16. In such embodiments, data from the sensing element 132 is analyzed by the controller 134 to determine if there is an over-speed or over-acceleration condition and to track or record operation of the electronic safety actuation device 100. If an over-speed/over-acceleration condition is detected, the electronic safety actuator 112 activates, thereby pulling up on the link member 120 and driving the contact surface 118 of the brake member 116 into frictional engagement with the guide rail 20, thus applying a braking force to stop the elevator car 16. In some embodiments, the electronic safety actuator 112 can transmit measured and/or recorded data from the controller 134 of the sensing system 130 to the elevator controller and the elevator controller can respond by transmitting an activation command back to the electronic safety actuator 112 to activate electronic safety actuation device 100 in response to detected events.

In other embodiments, the sensing elements 132 of the sensing system 130 may additionally include a gap sensor and/or inductive sensor. A gap sensor is typically configured to monitor a distance between the guide rail 20 and a target surface. An inductive sensor, such as an inductive proximity sensor for example, is similar to a gap sensor and will only detect the position of conductive or magnetic materials. The electronic safety actuator 112 may provide a convenient location, movable with the elevator car 16, for positioning such sensors. In embodiments where the speed of the elevator car 16 is monitored by sensing a guide rail 20, the corresponding speed sensing element 132 must be located in close proximity to the guide rail 20. Inclusion of a gap sensor and/or an inductive sensor may determine if the sensing element 132 monitoring the speed of the elevator car 16 is located an allowable distance from the guide rail 20 to ensure accuracy of the speed measurement. Further, the gap sensor and/or inductive sensor may also be used to monitor whether the electronic safety actuator 112 is in proper engagement with the rail 20 during movement of the elevator car 16 through the hoistway.

The sensing system 130 of the electronic safety actuation device 100 may also be utilized to monitor or evaluate one or more parameters associated with the ride quality of the elevator car 16 as it moves throughout the hoistway. The term "ride quality" as used herein is intended to include not only the vibration and/or noise experienced within the elevator car 16, but also the structural configuration of the guide rails 20 supporting the elevator car 16, which may contribute to the vibration and/or noise within the car 16. Depending on what type of sensing elements 132 are included in the actuator 112, different characteristics of the elevator system 10 associated with the ride quality may be measured.

In embodiments where one of the sensing elements 132 includes a velocity sensor and accelerometer, the same speed and acceleration information collected to determine if the elevator car 16 is travelling in an over-speed condition may also be used to monitor the vibrations experienced by the elevator car 16. In such embodiments, a filter may be applied to the collected information to identify portions where the measured vibration exceeds an allowable threshold.

Alternatively, or in addition, one or more of the sensing elements 132 may be used to monitor a condition of the guide rail 20. For example, in embodiments where the sensing elements 132 include an optical sensor or laser, the optical sensor or laser may also be used configured to monitor or measure a surface roughness of the guide rail 20 to identify locations where the roughness is outside of an allowable limit. Further, in other embodiments, one or more sensing elements 132 may also be configured to monitor the distance between the sensing element 132 and one or more surfaces of the guide rail 20. When monitoring the guide rail 20, a combination of like or different sensing elements 132 may be used to distinguish between the motion of the elevator car 16 relative to the guide rail 20 and a defect within the guide rail 20. For example, if a brief change in the gap or distance between the guide rail 20 and a sensing element 132 is detected, but there is no corresponding signal from a secondary sensing element 132, such as a lateral accelerometer for example, it can be determined that the change in the gap was the result of a rail defect.

This distance information can be used to identify locations where debris has accumulated on the rail 20 or to identify locations where the rail 20 deviates from a plane, i.e. the rail 20 is wavy or crooked. In any of the embodiments where a sensing element 132 of the sensor system 130 cooperates with the guide rail 20, the sensing element 132 may be configured to detect the occurrence of rail support brackets and joints or fishplates disposed between adjacent rail segments and any misalignment thereof. For example, in an embodiment, the controller 134 is configured to continuously monitor the vertical position of the elevator car 16 within the hoistway. A sensing element 132, such as an accelerometer for example, may be used to detect the lateral acceleration of the car 16*t* caused by non-straightness of the guide rail 20. Non-straightness is typically caused by stiffness variations in the guide rail 20 related to support points, such as rail brackets, and joints in the guide rail 20.

As the elevator car 16 moves through the hoistway, the data from the sensing elements 132 is stored and analyzed by the controller 134 to determine one or more regions within the path of movement of the elevator car 16 that require maintenance. Regions within the path of movement where maintenance is required are identified where the sensed parameter(s) deviates from a threshold or expected tolerance. The occurrence of such deviations along with their corresponding positions along the length of the guide rail 20 may be recorded. This data rimy be used to determine not only where the profile of the rail 20 has deviated from its intended linear path, but also which rail brackets or joints require adjustment to achieve a smoother path of travel.

If one or more thresholds are exceeded, the sensing system 130 may be configured to generate a notification that a maintenance operation should be performed on the elevator system 10. For example, maintenance operations can include, but are not limited to, manual inspection, repair, and/or replacement. The notification can be as simple as turning on a light or other indicator within the elevator car to indicate that maintenance should be performed or a diagnostic should be performed to determine the source of the notification. In other embodiments, the notification can be an alarm or alert that provides audible, visual, or other indication that maintenance is required. Further still, in some embodiments, the notification can be a message that is transmitted from the sensing system 130 (or a connected elevator controller) to a maintenance facility or other remote location. In some embodiments, the specific notification can be associated with the specific threshold that is exceeded, such that certain thresholds may indicate an inspection is required and thus an inspection notification is generated/transmitted, and a different notification can be generated/transmitted if a critical threshold is exceeded, such as requiring repair or replacement.

Those of skill in the art will appreciate that various example embodiments are shown and described herein, each having certain features in the particular embodiments, but the present disclosure is not thus limited. That is, features of the various embodiments can be exchanged, altered, or otherwise combined in different combinations without departing from the scope of the present disclosure.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. A safety actuation device for an elevator system including an elevator car and a guide rail, comprising:

a safety brake disposed on the elevator car;

an electronic safety actuator mechanically connected to the safety brake via a link member, the electronic safety actuator being operable to actuate the safety brake, the electronic safety actuator including at least one sensor having a target surface configured to monitor one or more parameters associated with a ride quality of the elevator car, wherein the one or more parameters includes a condition of the guide rail, and the at least one sensor is mounted to the electronic safety actuator to detect a surface of the guide rail as the elevator car moves, the target surface of the at least one sensor being separated from the surface of the guide rail by a gap.

2. The safety actuation device of claim 1, wherein the one or more parameters associated with the ride quality of the elevator car includes an acceleration of the elevator car.

3. The safety actuation device of claim 1, wherein the condition of the guide rail includes a surface roughness of the guide rail.

4. The safety actuation device of claim 1, wherein the condition of the guide rail includes a straightness of the guide rail.

5. The safety actuation device of claim 1, wherein the condition of the guide rail includes a distance between the electronic safety actuator and the guide rail.

6. The safety actuation device of claim 1, wherein the at least one sensor is an accelerometer.

7. The safety actuation device of claim 1, wherein the at least one sensor is an optical sensor or laser.

8. The safety actuation device of claim 1, wherein the at least one sensor is one of a gap sensor and an inductive sensor.

9. The safety actuation device of claim 1, wherein the at least one sensor includes a first sensor for monitoring a speed of the elevator car and a second sensor for determining if the first sensor is located an acceptable distance from the guide rail.

10. A method of operating an elevator system including an elevator car and a guide rail, the method comprising:

moving the elevator car and an electronic safety actuator and safety brake mounted to the elevator car within a hoistway, wherein the electronic safety actuator is mechanically coupled to the safety brake a via a link member, the electronic safety actuator being operable to actuate the safety brake;

monitoring one or more parameters associated with a ride quality of the elevator car using a target surface of at least one sensor of the electronic safety actuator as the elevator car moves within the hoistway, wherein the one or more parameters is a condition of the guide rail, and the at least one sensor is positioned to detect a surface of the guide rail, the target surface of the at least one sensor being separated from the surface of the guide rail by a gap.

11. The method of claim 10, further comprising forcing a safety brake operably coupled to the electronic safety actuator against the guide rail to brake movement of the elevator car.

12. The method of claim 10, further comprising:

receiving information from the at least one sensor monitoring the one or more parameters associated with the ride quality; and comparing the received information against at least one preset threshold.

13. The method of claim 12, further comprising identifying one or more regions of a path of movement of the elevator car where maintenance is required.

14. The method of claim 13, wherein identifying one or more regions of the path of movement of the elevator car where maintenance is required includes determining locations of the guide rail where the received information exceeds the at least one preset threshold.

15. The method of claim 14, further comprising generating a notification that maintenance is required at the locations of the guide rail where the received information exceeds the at least one preset threshold.

16. The method of claim 10, wherein a single sensor of the at least one sensor monitoring the speed of the elevator car and monitors the one or more parameters associated with the ride quality of the elevator car.

17. The method of claim 10, wherein the at least one sensor includes a first sensor and a second sensor, the first sensor being operable to monitor a speed of the elevator car and the second sensor being operable to monitor one or more parameters associated with the ride quality of the elevator car.

18. The method of claim 17, wherein the second sensor determines if the first sensor is located an acceptable distance from the guide rail.

* * * * *